US008176575B2

(12) United States Patent
Tsuzuki

(10) Patent No.: US 8,176,575 B2
(45) Date of Patent: May 15, 2012

(54) SHIELD FOR HELMET, AND HELMET INCLUDING SUCH SHIELD

(75) Inventor: Moichi Tsuzuki, Saitama (JP)

(73) Assignee: Shoei Co., Ltd., Tokyo (JP)

( * ) Notice: Subject to any disclaimer, the term of this patent is extended or adjusted under 35 U.S.C. 154(b) by 471 days.

(21) Appl. No.: 12/434,805

(22) Filed: May 4, 2009

(65) Prior Publication Data

US 2010/0037372 A1 Feb. 18, 2010

(30) Foreign Application Priority Data

Aug. 18, 2008 (JP) ..... 2008-209792

(51) Int. Cl.
*A42B 1/08* (2006.01)

(52) U.S. Cl. ..... 2/424; 2/171.3

(58) Field of Classification Search ..... 2/171.3, 2/411, 424, 410, 425, 422
See application file for complete search history.

(56) References Cited

U.S. PATENT DOCUMENTS

| | | | | |
|---|---|---|---|---|
| 5,058,212 | A * | 10/1991 | Kamata | 2/424 |
| 5,212,843 | A * | 5/1993 | Kamata | 2/424 |
| 5,388,277 | A * | 2/1995 | Taniuchi | 2/422 |
| 6,226,803 | B1 * | 5/2001 | Tanaka | 2/424 |
| 6,405,382 | B2 * | 6/2002 | Shida | 2/171.3 |
| 6,925,657 | B2 * | 8/2005 | Takahashi et al. | 2/412 |
| 7,376,981 | B2 * | 5/2008 | Shida | 2/424 |
| 7,398,561 | B2 * | 7/2008 | Kim et al. | 2/424 |
| 2005/0204446 | A1 | 9/2005 | Wright | |
| 2007/0226880 | A1 * | 10/2007 | Shida | 2/410 |

FOREIGN PATENT DOCUMENTS

| | | |
|---|---|---|
| JP | S52-99024 | 7/1977 |
| JP | S53-117322 | 9/1978 |
| JP | S55-96128 | 7/1980 |
| JP | H2-115528 | 9/1990 |
| JP | H3-1927 | 1/1991 |

* cited by examiner

*Primary Examiner* — Danny Worrell
(74) *Attorney, Agent, or Firm* — Jones Day

(57) ABSTRACT

In a shield for a helmet according to this invention, an air introducing mechanism portion disposed at a region including a lower end portion of a shield main body portion and its vicinity includes a large number of vent holes extending substantially in a vertical direction so that a traveling wind can flow substantially upward from substantially below substantially along the inner surface of the shield main body portion. This invention can provide a shield for a helmet which, despite that raindrops and the like will enter inside the shield main body portion at a low possibility, can introduce the traveling wind inside the shield main body portion well, and in which the shield main body portion can be worked comparatively well and the strength of the shield main body portion is not particularly impaired.

27 Claims, 7 Drawing Sheets

SHIELD FOR HELMET, AND HELMET INCLUDING SUCH SHIELD

TECHNICAL FIELD

The present invention relates to a shield for a helmet, comprising a shield main body portion and an air introducing mechanism portion disposed at a region including a lower end portion of the shield main body portion and a vicinity thereof. The present invention also relates to a helmet including such a shield.

BACKGROUND OF THE INVENTION

In a full-face-type helmet or the like, as disclosed in, e.g., the microfilm of Japanese Utility Model Application No. 51-6012 (Japanese Utility Model Laid-Open No. 52-99024) (to be referred to as "the above patent reference" hereinafter), an air intake hole is formed in a shield so the shield will not fog. In the shield of the helmet disclosed in the above patent reference (to be referred to as "the shield of the above patent reference"), a plurality of comparatively large air intake holes extending through the shield in the direction of thickness are arranged in a region including the lower end portion of the shield and its vicinity to form a row along the lower end portion. Each of the plurality of air intake holes is closed with a mesh.

In the case of the shield of the above patent reference, as the air intake holes extend through the shield (in other words, the original shield) in the direction of thickness, through holes must be formed in the original shield itself. The length of each air intake hole is short as it is substantially equal to the thickness of the original shield. In addition, the longitudinal direction of the air intake hole is substantially horizontal. Therefore, not only the traveling wind enters inside the shield through the air intake holes, but also raindrops and the like can enter inside the shield through the air intake holes. As the air intake holes must be formed in the original shield itself to extend through it, the shield cannot be worked very well, and the strength of the shield may be impaired.

SUMMARY OF THE INVENTION

The present invention is to effectively correct the drawbacks of the shield of the above patent reference by a comparatively simple arrangement.

It is, therefore, an object of the present invention to provide a shield for a helmet which can cause the traveling wind to flow substantially upward from substantially below substantially along the inner surface of the shield main body portion through a large number of vent holes formed in an air introducing mechanism portion, so that the interior of the head protecting body of the helmet can be ventilated well (particularly, fogging of the shield main body portion can be prevented effectively), and in which raindrops and the like are less likely to enter inside the shield main body portion through the large number of vent holes, and a helmet including such a shield.

It is another object of the present invention to provide a shield for a helmet in which a large number of vent holes need not be formed in a shield main body portion to extend through it, so that the shield main body can be worked well and the strength of the shield main body portion will not be impaired, and a helmet including such a shield.

It is still another object of the present invention to provide a shield for a helmet in which a shield main body portion can be used not only as being attached with a negative pressure generating plate portion but also alone, so that the shield main body portion has a good compatibility, and a helmet including such a shield.

It is still another object of the present invention to provide a shield for a helmet in which the thickness of an air introducing mechanism portion in the back-and-forth direction can be reduced so that the inner surface of the shield and the rim of the window opening of a head protecting body can come into contact with each other well, and a helmet including such a shield.

It is still another object of the present invention to provide a shield for a helmet which can accelerate the traveling wind to flow substantially upward from substantially below in a large number of vent holes, and a helmet including such a shield.

It is still another object of the present invention to provide a shield for a helmet which can accelerate a traveling wind, flowing substantially upward from substantially below in a large number of holes, to flow out from the upper ends of the large number of vent holes substantially upward, and a helmet including such a shield.

The present invention, in its first aspect, relates to a shield for a helmet, comprising a shield main body portion and an air introducing mechanism portion disposed at a region including a lower end portion of the shield main body portion and a vicinity thereof, characterized in that the air introducing mechanism portion comprises a large number of vent holes extending substantially in a vertical direction so that a traveling wind can flow substantially upward from substantially below substantially along an inner surface of the shield main body portion.

Preferably, in the present invention according to its first aspect, the shield further comprises a negative pressure generating plate portion continuously provided to the shield main body portion so as to extend substantially upward from a region including an upper end portion of the shield main body portion and a vicinity thereof. In this case, the negative pressure generating plate portion may be formed independently of the shield main body portion and thereafter attached to the shield main body portion.

In the first aspect of the present invention, preferably, the large number of vent holes are disposed in a row to extend substantially in a horizontal direction as a whole along the inner surface of the shield main body portion. Furthermore, in the first aspect of the present invention, preferably, the air introducing mechanism portion comprises, substantially under the large number of vent holes, an air receiving surface capable of introducing a traveling wind, flowing relatively to substantially below the large number of vent holes, to the large number of vent holes. In this case, preferably, the air introducing mechanism portion further comprises a large number of air guide grooves defined by a large number of partition plate portions provided to the air receiving surface. Also, preferably, the large number of air guide grooves correspond to the large number of vent holes substantially in one to one correspondence.

In the first aspect of the present invention, preferably, the air introducing mechanism portion further comprises an air guide surface, extending substantially upward from a region including upper end portions of the plurality of vent holes and vicinities thereof to be substantially parallel to the inner surface of the shield main body portion, so as to guide air, flowing out relatively substantially upward from upper ends of the large number of vent holes, substantially further upward.

In the first aspect of the present invention, preferably, the number of vent holes falls within a range of 20 to 300 (desirably 30 to 200). Also, in the first aspect of the present invention, preferably, the individual vent hole has an average cross-section area that falls within a range of 1.5 $mm^2$ to 80 $mm^2$ (desirably 2 $mm^2$ to 40 $mm^2$). Also, in the first aspect of the present invention, preferably, the individual vent hole has an average length that falls within a range of 3 mm to 40 mm (desirably 4 mm to 30 mm). Also, in the first aspect of the present invention, preferably, adjacent ones of the vent holes have an average gap that falls within a range of 0.1 mm to 3 mm (desirably 0.2 mm to 2 mm). Also, in the first aspect of the present invention, preferably, the individual air receiving surface has an average width in the vertical direction that falls within a range of 0.5 mm to 10 mm (desirably 1 mm to 6 mm). Also, in the first aspect of the present invention, preferably, the air introducing mechanism portion in a developed state has a length in the horizontal direction that falls within a range of 8 cm to 40 cm (desirably 12 cm to 32 cm).

Furthermore, the present invention, in its second aspect, relates to a helmet characterized by including a shield according to the first aspect which is pivotally mounted on a head protecting body.

The above, and other, objects, features and advantages of the present invention will become readily apparent from the following detailed description thereof which is to be read in connection with the accompanying drawings.

DETAILED DESCRIPTION OF THE INVENTION

An embodiment in which the present invention is applied to a full-face-type helmet will be described in "1. Schematic Arrangement of Helmet as a Whole", "2. Arrangement of Shield" and "3. Operation of Shield" with reference to the accompanying drawings.

1. Schematic Arrangement of Helmet as a Whole

Figure 1:
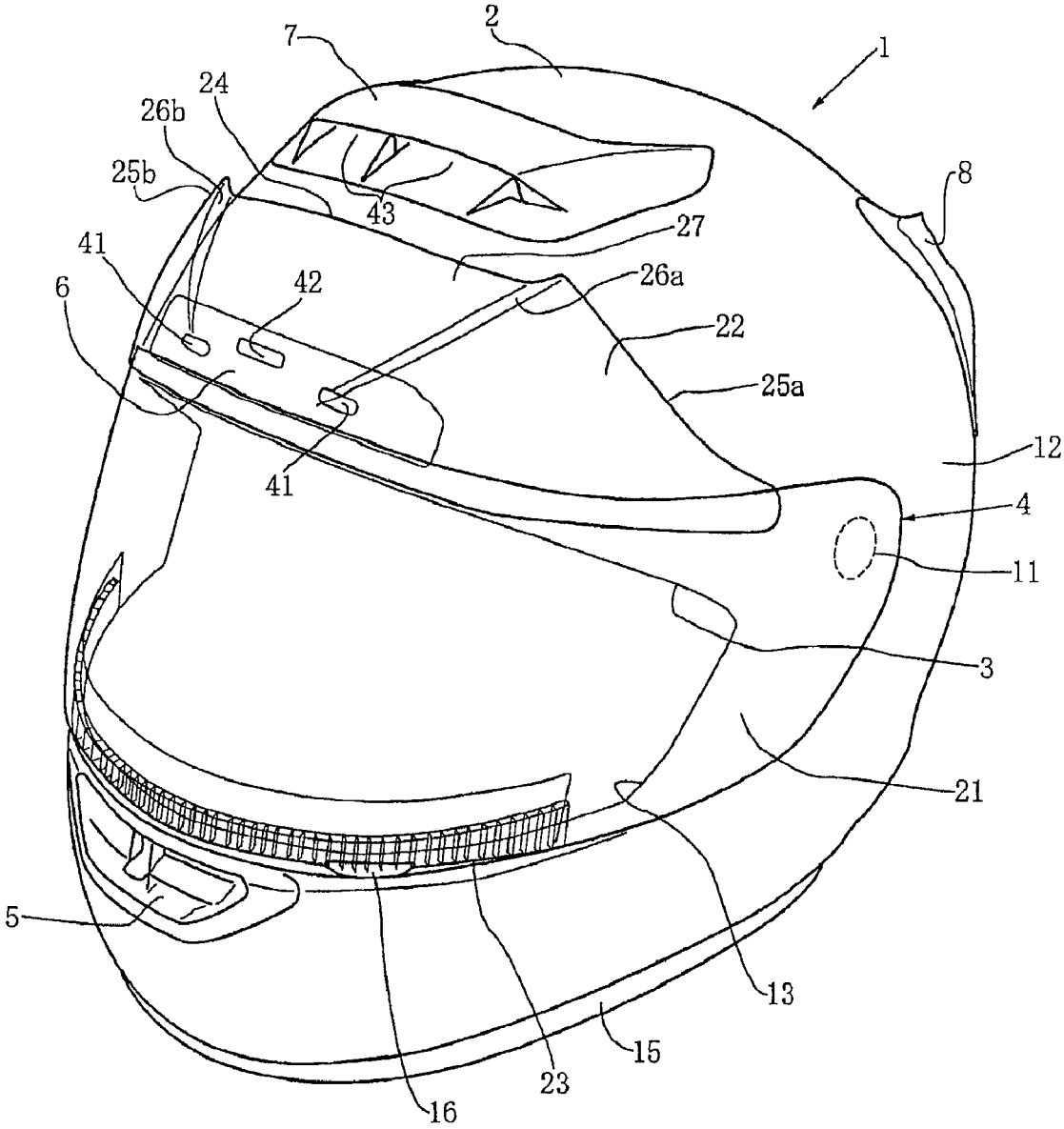
FIG. 1 is a schematic perspective view of a full-face-type helmet as a whole according to an embodiment of the present invention.
Figure 2:
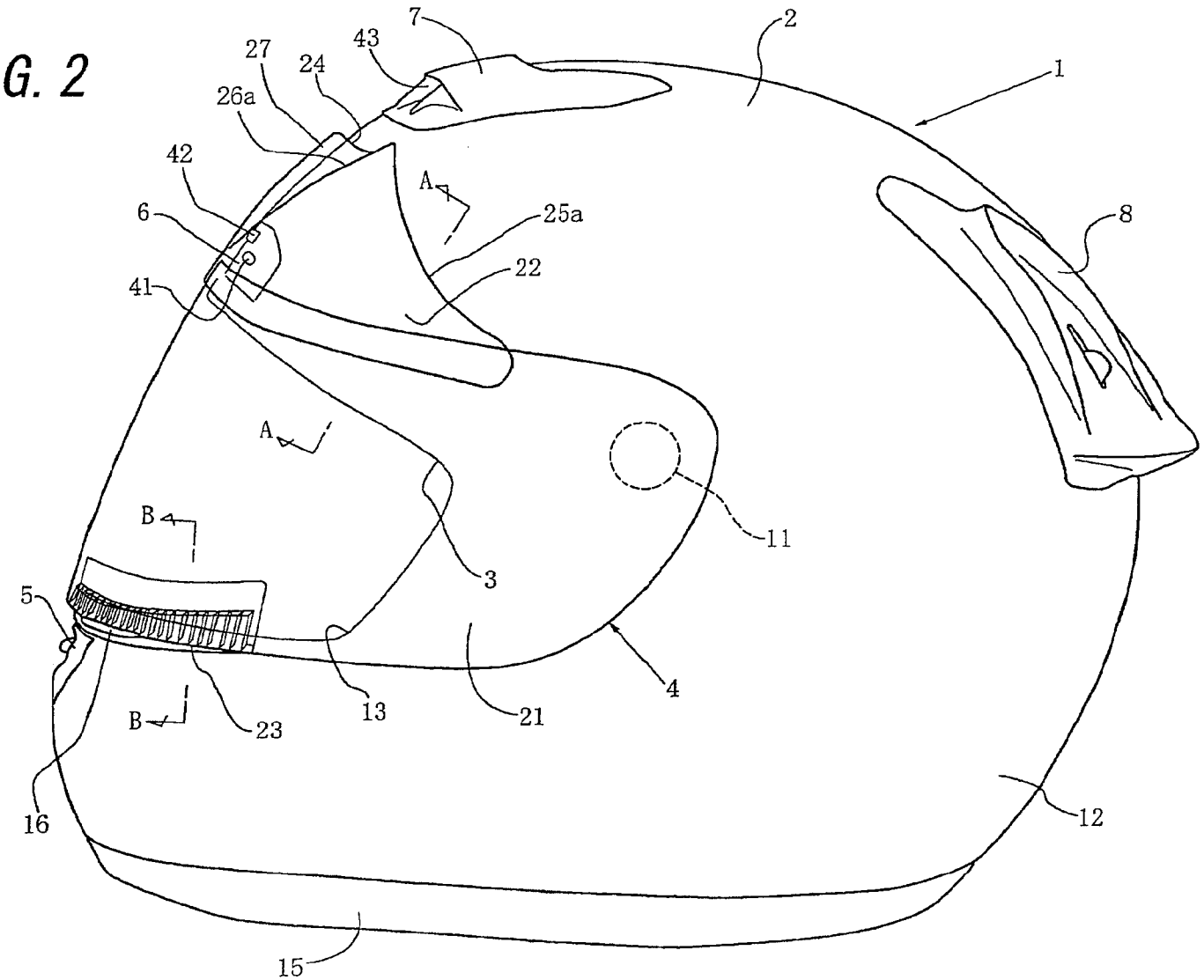
FIG. 2 is a schematic left side view of the full-face-type helmet as a whole shown in FIG. 1.

As shown in FIGS. 1 and 2, a full-face-type helmet 1 includes:

(a) a full-face-type head protecting body 2 to be worn on the head of a helmet wearer such as a motorbike rider, (b) a shield 4 capable of opening/closing a window opening 3 formed in the front surface of the head protecting body 2 to oppose a portion between the forehead and chin (i.e., the central portion of the face) of the helmet wearer, and (c) a pair of left and right chin straps (not shown) attached to the inside of the head protecting body 2.

As shown in FIGS. 1 and 2, of the head protecting body 2, portions respectively corresponding to the chin, forehead, vertex, back part and/or the like of the head of the helmet wearer are provided with one or a plurality of ventilators (a chin region ventilator 5, forehead region ventilator 6, vertex region ventilator 7 and back head region ventilator 8 in the embodiment shown in the drawings), if necessary, to ventilate the head protecting body 2. Regions including the left and right sides of the shield 4 and their vicinities are pivotally mounted to an outer shell 12, which forms the outer wall of the head protecting body 2, with a pair of left and right mounting shaft portions 11 which form shield mounting mechanisms, respectively. The ventilators 5 to 8 and the shield mounting mechanisms are not the main part of the present invention, and a repetitive description will be omitted in this specification.

Figure 3:
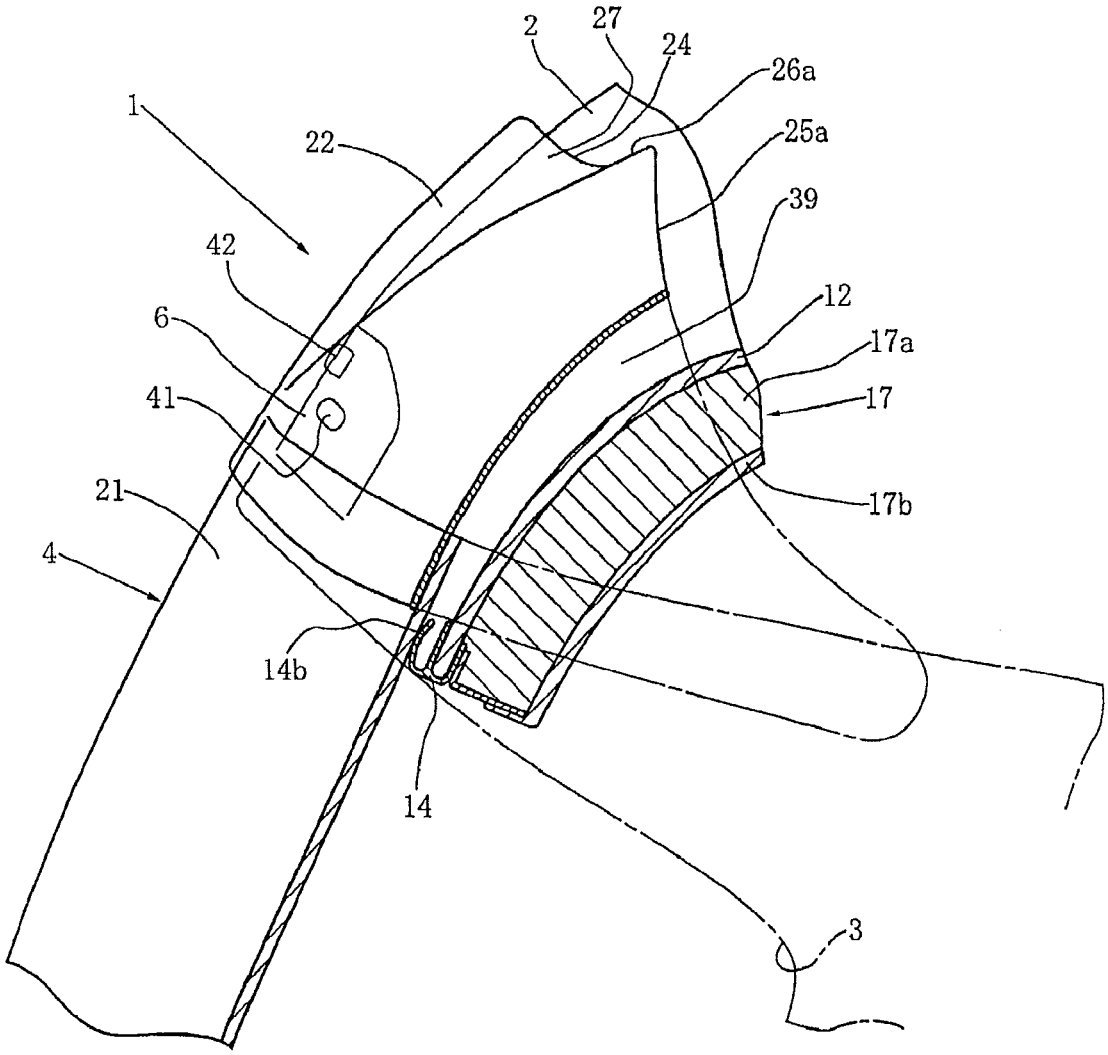
FIG. 3 is an enlarged sectional view taken along the line A-A in FIG. 2.
Figure 4:
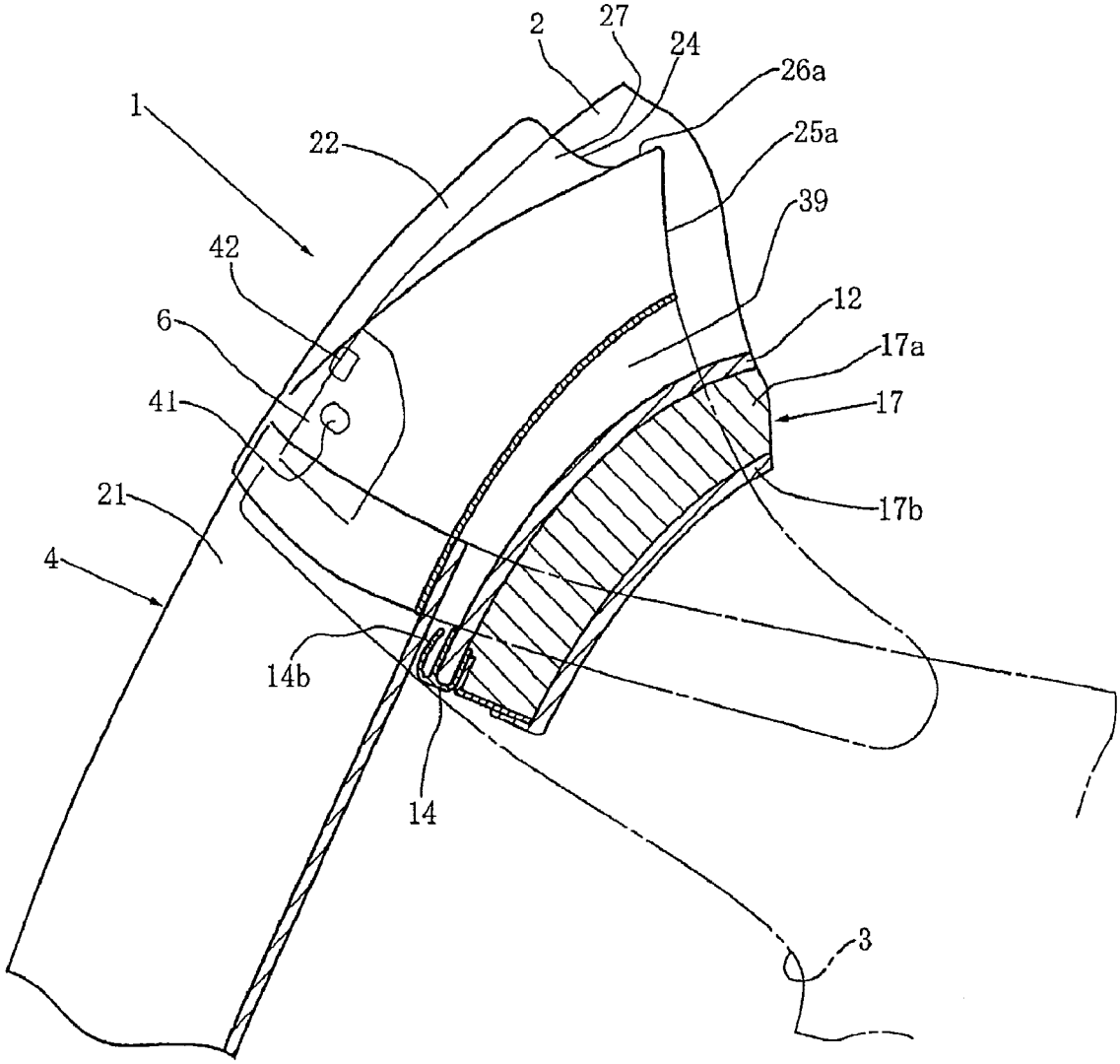
FIG. 4 is an enlarged sectional view taken along the line A-A in FIG. 2 in a state in which a negative pressure acts on a window opening rim member.
Figure 5:
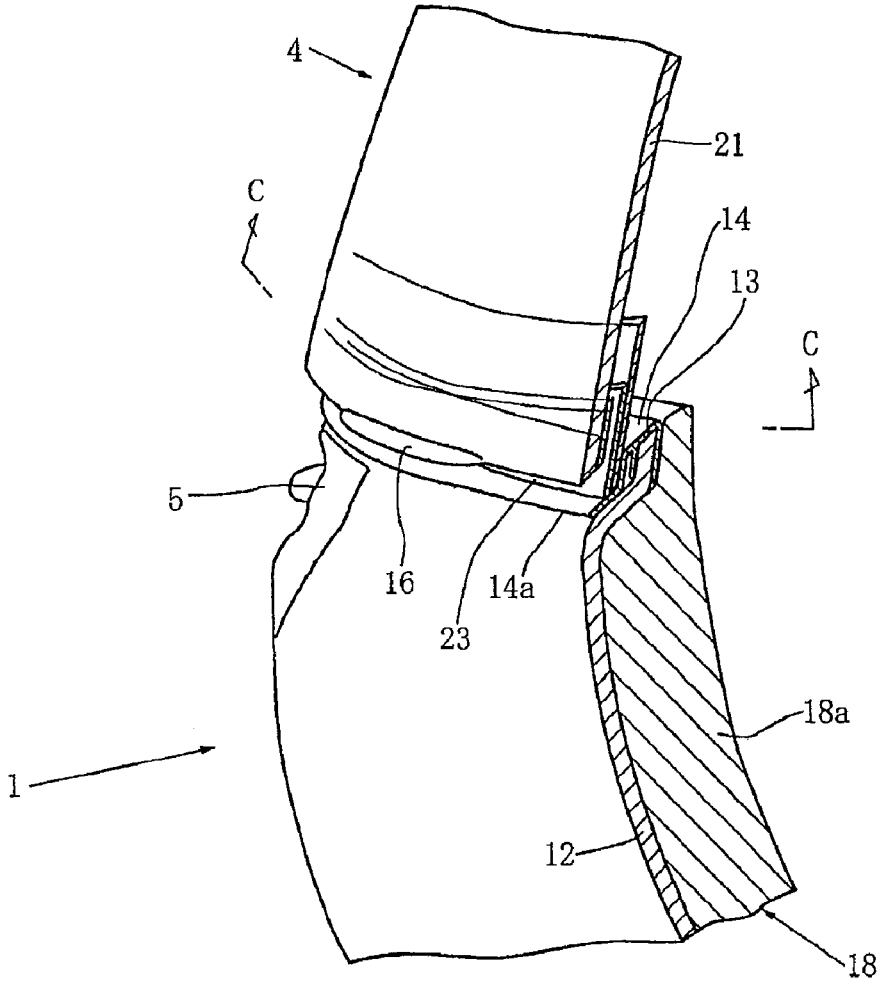
FIG. 5 is an enlarged sectional view taken along the line B-B in FIG. 2.

As is known well, the outer shell 12 can be made of a composite material obtained by backing the inner surface of a shell main body, made of a hard material with large strength such as FRP or another synthetic resin, with a flexible sheet such as a porous unwoven fabric. As shown in FIGS. 3 and 4, a window opening rim member (a window opening rim member having a substantially E-shaped cross section in the embodiment shown in the drawings) 14 having, e.g., a substantially U- or E-shaped section is attached to a window opening 13 formed in the outer shell 12 to form the window opening 3 of the head protecting body 2, substantially throughout the entire circumference by, e.g., adhesion with an adhesive or a double-sided adhesive tape. As shown in FIGS. 1, 2 and 5, a projecting ridge 14*a* is continuously formed at the lower end portion of the window opening rim member 14 along the lower end portion of the window opening 13 substantially horizontally. The lower end portion of the shield 4, when it is at a full-closing position, abuts against the projecting ridge 14*a*. Furthermore, a lower rim member 15 having, e.g., a substantially U-shaped section is attached to the lower end portion of the outer shell 12 substantially throughout the entire circumference by, e.g., adhesion with an adhesive or a double-sided adhesive tape. As is known well, the window opening rim member 14 can be made of a highly flexible elastic material such as synthetic rubber. As is known well, the lower rim member 15 can be made of a soft material such as foamed vinyl chloride, synthetic rubber, or another soft synthetic resin. In FIGS. 1 and 2, reference numeral 16 denotes a finger rest integrally formed at the lower end portion of substantially the central portion of the shield 4. The helmet wearer places his finger on the finger rest 16 when reciprocally pivoting the shield 4 upward and downward.

As shown in FIGS. 3 to 5, the head protecting body 2 further includes:

(a) a head backing member 17 which is attached to the inner surface of the outer shell 12 by adhesion or the like to be in contact with it in a forehead region, vertex region, left and right head regions and a back head region respectively opposing the forehead, vertex, left and right parts of the head and back part of the head of the helmet wearer, and (b) a chin-and-cheek backing member 18 which is attached to the inner surface of the outer shell 12 by adhesion or the like to be in contact with it in a chin region and cheek regions substantially opposing the chin and cheeks of the helmet wearer.

As shown in FIGS. 3 and 4, the head backing member 17 is formed of an impact-on-the-head absorbing liner 17*a* and an air-permeable head backing cover 17*b* which is attached to the inner surface of the impact-on-the-head absorbing liner 17*a* to cover substantially its entire inner surface. As shown in FIG. 5, the chin-and-cheek backing member 18 is formed of an impact-on-the-chin-and-cheek absorbing liner 18*a* and a pair of left and right cheek blockish inside pads (not shown) which are attached to the inner surface of the impact-on-the-chin-and-cheek absorbing liner 18*a* to be in contact with it in the left and right cheek regions respectively opposing the left and right cheeks of the helmet wearer. The main body portions of the impact-on-the-head absorbing liner 17*a* and impact-on-the-chin-and-cheek absorbing liner 18*a* shown in FIGS. 3 to 5 can be made of a material with appropriate rigidity and appropriate plasticity such as foamed polystyrene or another synthetic resin. The main body portion of the head backing cover 17*b* can be formed of a combination of, e.g., a woven fabric portion and a porous unwoven fabric portion, which is obtained by laminating layers, having appropriate shapes and made of a flexible elastic material such as urethane foam or another synthetic resin, on a surface (i.e., the outer surface) which opposes the impact-on-the-head absorbing liner 17*a*, or two surfaces.

2. Arrangement of Shield

Figure 8:
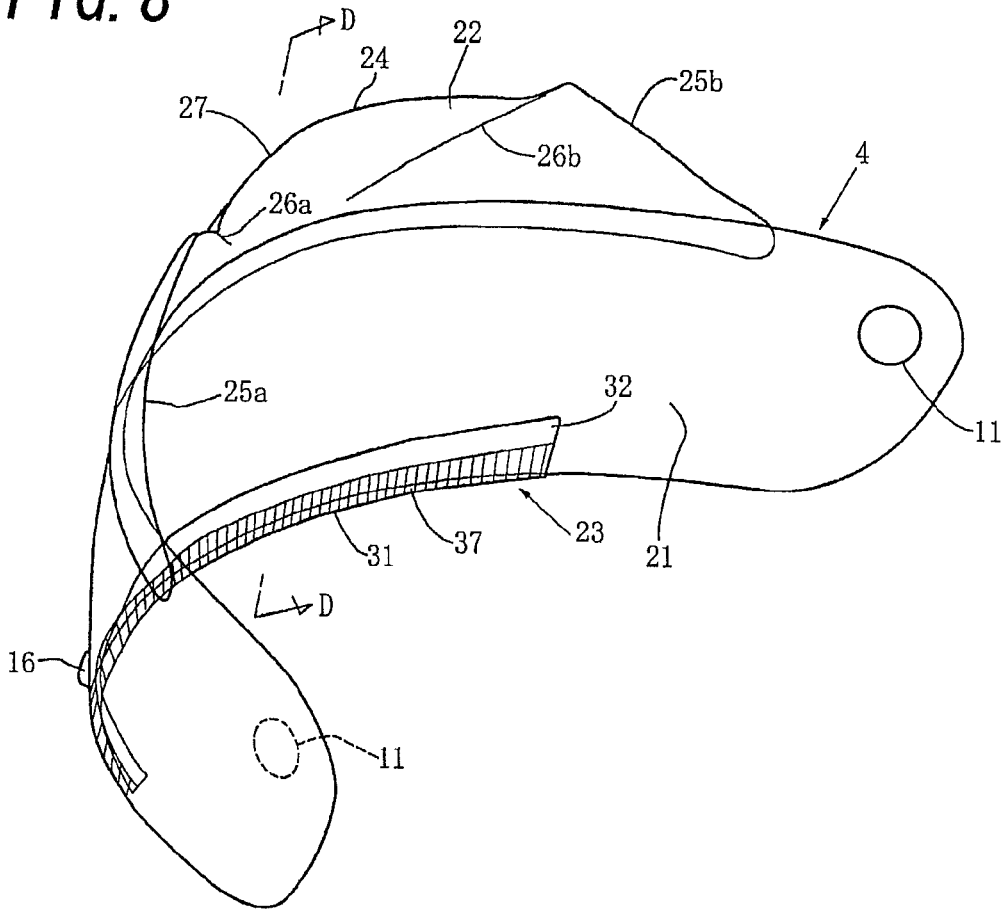
FIG. 8 is a perspective view seen from inside the entire shield shown in FIG. 1.
Figure 9:
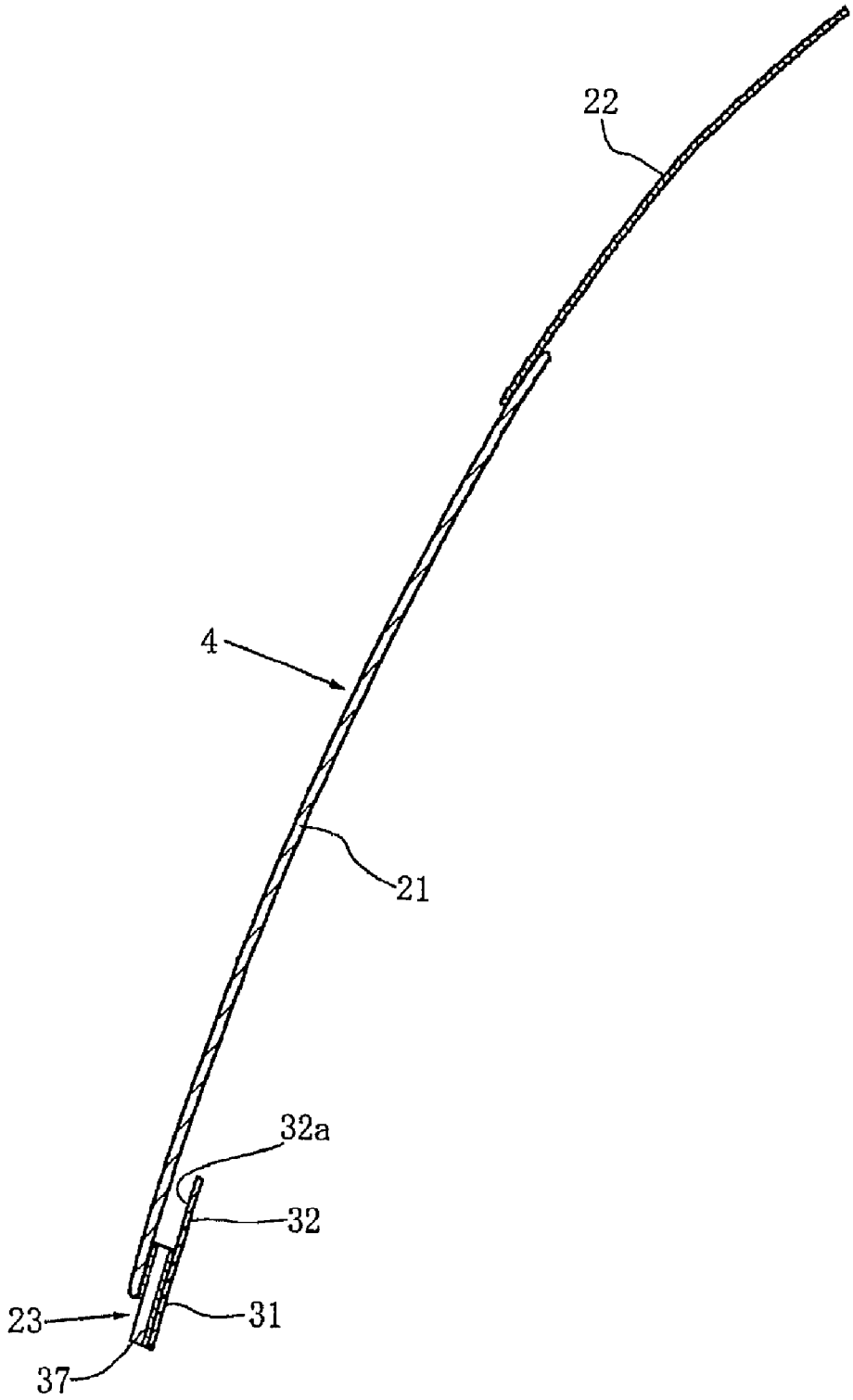
FIG. 9 is an enlarged sectional view taken along the line D-D in FIG. 8.

As shown in FIGS. 8 and 9, the shield 4 basically includes a shield main body portion 21 as the original shield, a negative pressure generating plate portion 22 continuously provided to the upper portion of the shield main body portion 21, and an air introducing mechanism portion 23 disposed at the lower portion of the shield main body portion 21. The shield main body portion 21, negative pressure generating plate portion 22 and air introducing mechanism portion 23 can be made of a transparent or translucent hard material such as polycarbonate or another synthetic resin. Each of the negative pressure generating plate portion 22 and air introducing mechanism portion 23 can be opaque partly or entirely.

As shown in FIGS. 8 and 9, as the shield main body portion 21 of the shield 4 can be an original shield, its shape can be somewhat larger than that of the window opening 13 of the outer shell 12, so the shield main body portion 21 can open/close the window opening 3 of the head protecting body 2 shown in FIGS. 1 and 2. Hence, the regions including the left and right ends of the shield main body portion 21 and their vicinities are provided with the pair of left and right mounting shaft portions 11, respectively, which constitute the shield mounting mechanisms. Also, the finger rest 16 is integrally formed at the lower end portion of substantially the central portion of the shield main body portion 21.

As shown in FIGS. 3, 4, and 9, the negative pressure generating plate portion 22 of the shield 4 is formed independently of the shield main body portion 21. The lower end portion of the inner surface of the negative pressure generating plate portion 22 is mounted and fixed to the upper end portion of the outer surface of the shield main body portion 21 with screws or rivets, by adhesion with an adhesive or a double-sided adhesive tape, recess/projection fitting, or the like. As shown in FIGS. 1 and 8, the upper end of the negative pressure generating plate portion 22 is formed of a central portion 24 extending substantially horizontally and left and right inclined portions 25*a* and 25*b* extending from the left and right ends, respectively, of the central portion 24 substantially obliquely downward. As shown in FIGS. 1 and 8, the negative pressure generating plate portion 22 has a left step 26*a* which extends from a region including the bonding portion of the central portion 24 and left inclined portion 25*a* and its vicinity toward substantially the center in the horizontal direction substantially obliquely downward to a region including the lower end portion of the negative pressure generating plate portion 22 and its vicinity. The negative pressure generating plate portion 22 also has a right step 26*b* which extends from a region including the bonding portion of the central portion 24 and right inclined portion 25*b* and its vicinity toward substantially the center in the horizontal direction substantially obliquely downward to a region including the lower end portion of the negative pressure generating plate portion 22 and its vicinity.

As shown in FIGS. 1 and 2, the left step 26*a* of the negative pressure generating plate portion 22 bulges leftward from the center of the negative pressure generating plate portion 22. The right step 26*b* bulges rightward from the center of the negative pressure generating plate portion 22. Hence, a recess 27 is formed between the left step 26*a* and right step 26*b* in the outer surface of the negative pressure generating plate portion 22. The recess 27 substantially corresponds to the vertex region ventilator 7 in the back-and-forth direction of the head protecting body 2. As shown in FIG. 9, the negative pressure generating plate portion 22 is thinner than the shield main body portion 21 and has a substantially constant thickness. Hence, a projection substantially corresponding to the recess 27 is formed on the inner surface of the negative pressure generating plate portion 22. The gap between the inner surface of the negative pressure generating plate portion 22 and the outer surface of the outer shell 12 is small particularly at the projection so a negative pressure (to be described later) can be generated there readily.

Figure 6:
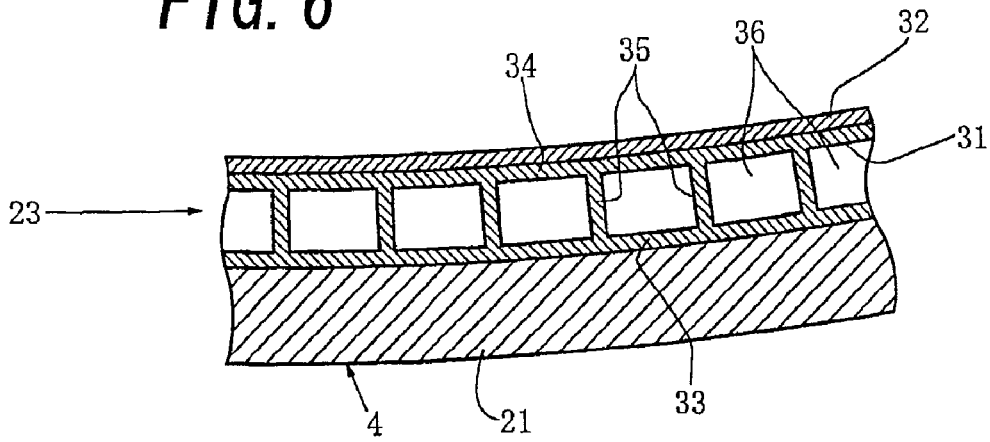
FIG. 6 is an enlarged sectional view taken along the line C-C in FIG. 5.
Figure 7:
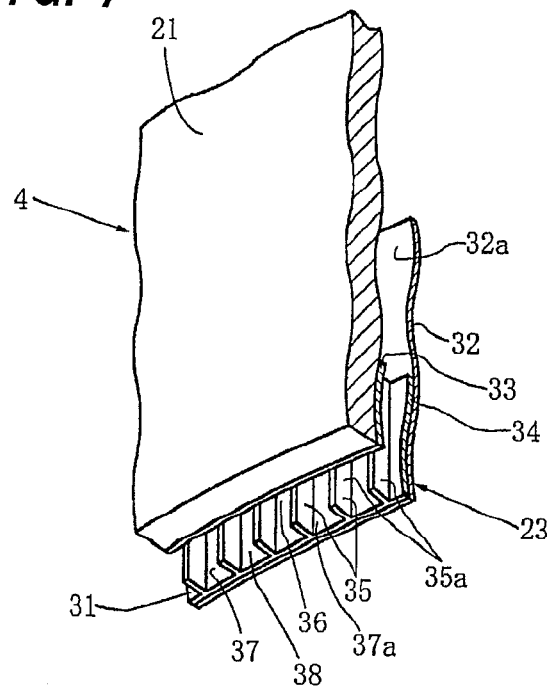
FIG. 7 is an enlarged perspective view of part of the lower portion of a shield shown in FIG. 5.

As shown in FIGS. 5 to 7, in the embodiment shown in the drawings, the air introducing mechanism portion 23 of the shield 4 shown in FIG. 8 includes an air introducing hole forming member 31 and air guide plate 32. The air introducing hole forming member 31 includes an outer plate portion 33 as one plate portion, an inner plate portion 34 as the other plate portion, and a large number of barrier portions 35. The inner plate portion 34 is integrally connected to the outer plate portion 33 via the large number of barrier portions 35 so the inner plate portion 34 is substantially parallel to the outer plate portion 33. The large number of barrier portions 35 are disposed between the outer plate portion 33 and inner plate portion 34 such that they are substantially equidistant and extend to form a substantially flat plane. Accordingly, in the air introducing hole forming member 31, a large number of vent holes 36 defined respectively by the outer plate portion 33, inner plate portion 34 and the pair of left and right barrier portions 35 form a row from the left to the right through the large number of barrier portions 35 sequentially.

As shown in FIGS. 5, 7 and 8, the outer plate portion 33 of the air introducing hole forming member 31 is attached to a region including the central portion of the lower end portion of the shield main body portion 21 and its vicinity by, e.g., adhesion with an adhesive or a double-sided adhesive tape. The air introducing hole forming member 31 projects most downward from the lower end of the shield main body portion 21 at substantially the center in the horizontal direction of the shield main body portion 21, and projects less gradually leftward and rightward until it does not substantially project at all. Therefore, as shown in FIG. 8, the air introducing hole forming member 31 includes a narrow projection 37 projecting downward from the lower end of the shield main body portion 21. The projection 37 becomes gradually narrow leftward and rightward from substantially the center in the horizontal direction until it barely projects at the left end and right end. For this reason, the left and right lower ends of the air introducing hole forming member 31 (in other words, the air introducing mechanism portion 23) rarely project downward from the lower end of the shield main body portion 21.

As shown in FIG. 7, the outer plate portion 33 of the air introducing hole forming member 31 does not cover the projection 37. Accordingly, the large number of barrier portions 35 are exposed to the front surface to form a large number of partition plate portions 35*a* on the projection 37. The upper ends of a large number of air guide grooves 38 which are defined by the large number of partition plate portions 35*a* to extend among them substantially in the vertical direction communicate with the lower ends of the large number of vent holes 36 substantially in one to one correspondence. The lower half of the air guide plate 32 is attached and fixed to the rear surface of the inner plate portion 34 by, e.g., adhesion with an adhesive or a double-sided adhesive tape. The lower half of the air guide plate 32 is preferably attached before the air introducing hole forming member 31 is attached to the shield main body portion 21. As the upper half of the air guide plate 32 projects substantially upward beyond the inner plate portion 34, it forms an air guide surface 32*a*.

As shown in FIGS. 6 and 7, the air introducing mechanism portion 23 having the above arrangement includes;

(a) the large number of vent holes 36 extending substantially in the vertical direction and forming a row as a whole that extends substantially in the horizontal direction, (b) the projection 37 having an air receiving surface 37*a* which can receive air (in other words, a traveling wind) flowing from relatively front and guide it to the large number of vent holes 36, (c) the large number of partition plate portions 35*a* formed on the projection 37 to extend substantially in the vertical direction, and (d) the air guide surface 32*a* extending from a region including the upper end portions of the vent holes 36 and their vicinities substantially upward to be substantially parallel to the inner surface of the shield main body portion 21 so that air flowing out substantially upward from the upper ends of the large number of vent holes 36 is guided further substantially upward.

According to the present invention, the large number of partition plate portions 35*a* described in the above item (c) are not always necessary, and neither is the projection 37 described in the above item (b) depending on the case. The inner plate portion 34 to form the large number of vent holes 36 described in the above item (a) can be omitted, and the lower half of the air guide plate 32 can be used as the inner plate portion 34. Depending on the case, the air guide surface 32*a* described in the above item (d) can be omitted. Although the large number of vent holes 36 form a row as a whole substantially in the horizontal direction in the embodiment shown in the drawings, they may form a plurality of rows, i.e., two rows or more. As far as the vent holes 36 are arranged along substantially the horizontal direction of the inner surface of the shield main body portion 21 to be preferably, sequentially adjacent to each other, they may be arranged randomly to disorder the row. Each of the large number of vent holes 36 has a substantially quadrangular cross-section, e.g., a substantially rectangular cross-section (in other words, so that the individual vent hole 36 forms a substantially rectangular parallelopiped as a whole). Alternatively, each of the large number of vent holes 36 can have a cross-section with an arbitrary shape, e.g., a substantially circular or substantially elliptic cross-section. The shapes of the large number of vent holes 36 need not always be uniform in the longitudinal direction, but they can fan out substantially upward from substantially below.

As shown in FIGS. 6 and 8, for example, the number of vent holes 36 formed in the air introducing mechanism portion 23 is 64 in the embodiment shown in the drawings. Generally, the number of vent holes 36 preferably falls within a range of 20 to 300 from the viewpoint of practicality, and desirably a range of 30 to 200. The area of the cross-section of each of the large number of vent holes 36 shown in FIG. 6 is about 6.5 $mm^2$ in the embodiment shown in the drawings. Generally, the average area of the cross-section of the individual vent hole 36 preferably falls within a range of 1.5 $mm^2$ to 80 $mm^2$ from the viewpoint of practicality, and desirably a range of 2 $mm^2$ to 40 $mm^2$. In the embodiment shown in the drawings, the length of each of the large number of vent holes 36 is about 8 mm at substantially the center of the air introducing mechanism portion 23 (in other words, the shield main body portion 21) and about 11 mm at each of a region including the left end of the air introducing mechanism portion 23 and its vicinity and a region including the right end of the air introducing mechanism portion 23 and its vicinity, thus being about 9.5 mm in average. Generally, the average length of the individual vent holes 36 (in other words, the average value of the lengths of the large number of vent holes 36) preferably falls within a range of 3 mm to 40 mm from the viewpoint of practicality, and desirably a range of 4 mm to 30 mm. The gap among the adjacent vent holes 36 (in other words, the thickness of each barrier portion 35) is about 0.5 mm in the embodiment shown in the drawings. Generally, the average gap between the adjacent vent holes 36 preferably falls within a range of 0.1 mm to 3 mm from the viewpoint of practicality, and desirably a range of 0.2 mm to 2 mm. The average width in the vertical direction (in other words, the average projecting length) of the projection 37 (in other words, the air receiving surface 37*a*) is about 2 mm in the embodiment shown in the drawings. Generally, the average width preferably falls within a range of 0.5 mm to 10 mm from the viewpoint of practicality, and desirably a range of 1 mm to 6 mm. The length of the air guide surface 32*a* in the vertical direction is about 10 mm in the embodiment shown in the drawings. Generally, the average length of the air guide surface 32*a* in the vertical direction preferably falls within a range of 2 mm to 50 mm from the viewpoint of practicality, and desirably a range of 3 mm to 30 mm. The length of the air introducing mechanism portion 23 (in other words, the air introducing hole forming member 31, air guide plate 32, projection 37 and air guide surface 32*a*) in the horizontal direction in a developed state is about 24 mm in the embodiment shown in the drawings. Generally, the length in the horizontal direction of the air introducing mechanism portion 23 in the developed state preferably falls within a range of 8 cm to 40 cm from the viewpoint of practicality, and desirably a range of 12 cm to 32 cm. When a plurality of air introducing mechanism portions 23 are to be disposed on the common shield main body portion 21 sequentially in the horizontal direction, the preferable ranges and desired ranges described above also apply to a case in which the plurality of air introducing mechanism portions 23 are gathered in the horizontal direction so they can be regarded as one air introducing mechanism portion 23.

3. Operation of Shield

When the shield 4 is pivoted backward downward as shown in FIGS. 1 to 3, the shield main body portion 21 of the shield 4 closes the window opening 3 of the head protecting body 2 (in other words, the window opening 13 of the outer shell 12). Unless the helmet wearer drives a motorbike, a region including substantially the entire circumference of the inner surface of the shield main body portion 21 and its vicinity (excluding a portion corresponding to the air introducing mechanism portion 23) and a region including the lower end portion of the inner surface of the air guide plate 32 of the air introducing mechanism portion 23 and its vicinity are in tight contact with a lip 14*b* of the window opening rim member 14 having a substantially E-shaped cross-section, as shown in FIG. 3. At the more distal end side of the lip 14*b*, the projecting ridge 14*a* (see FIG. 5) described above continues to the lip 14*b*. In the backward pivot state of the shield 4 shown in FIGS. 1 to 3, when the shield 4 is pivoted forward upward about the pair of left and right mounting shaft portions 11 as the fulcrum, the window opening 3 of the head protecting body 2 can be opened, as is known well. Then, a forward pivot state of the shield 4 can be obtained.

When the helmet wearer pivots the shield 4 backward, as shown in FIGS. 1 to 3, and drives the motorbike, the traveling wind relatively abuts against the air receiving surface 37*a* as the front surface of the projection 37 of the air introducing mechanism portion 23. The large number of air guide grooves 38 guide the traveling wind to substantially the lower ends of the large number of vent holes 36. As the traveling wind flows upward in the large number of vent holes 36 and is guided to substantially the upper ends of the vent holes 36, it flows further upward between the inner surface of the shield main body portion 21 and the air guide surface 32*a* of the air guide plate 32.

Other traveling winds flow relatively along the outer surface of the negative pressure generating plate portion 22 and the outer surface of the outer shell 12 shown in FIGS. 1 to 3. These flows draw out air in a gap 39 (see FIGS. 3 and 4) between the inner surface of the negative pressure generating plate portion 22 and the outer surface of the outer shell 12 which corresponds to this inner side, so that a negative pressure is generated in the gap 39. The negative pressure acts on the lip 14*b* of the window opening rim member 14 opposing the gap 39 and draws the lip 14*b* substantially upward. Hence, when the drawing force of the negative pressure becomes larger than the elastic closing force of the lip 14*b*, the lip 14*b* shown in FIG. 3 deflects and separates from the inner surface of the shield main body portion 21, as shown in FIG. 4. The window opening 3 in the head protecting body 2 accordingly communicates with the gap 39, and part of air in the head protecting body 2 and part of the traveling wind (in other words, air) which flow upward between the inner surface of the shield main body portion 21 and the air guide surface 32*a* as described above are drawn into the gap 39. As a result, the interior of the head protecting body 2 can be ventilated, and the inner surface of the shield main body portion 21 can be prevented from fogging. When the traveling wind is drawn into the gap 39, as described above, upward flow of the traveling wind in the large number of vent holes 36 is promoted to a certain degree.

When the negative pressure is generated in the gap 39, as described above, it also acts on vent holes 41 of the forehead region ventilator 6 shown in FIGS. 1 to 4. If the pair of left and right vent holes 41 are opened in advance by manipulating a shutter tab 42 of the forehead region ventilator 6, air in the head protecting body 2 is emitted outside through the vent holes 41. Air emitted outside mainly passes by the left and right sides of the left and right steps 26*a* and 26*b*, respectively, between the outer surface of the outer shell 12 and the inner surface of the negative pressure generating plate portion 22, and is emitted outside the helmet 1. Once the shield 4 is pivoted backward, the traveling wind flowing relatively backward from front along the outer surface of the recess 27 of the negative pressure generating plate portion 22 is guided by the outer surface of the recess 27 and effectively introduced to the inside of the head protecting body 2 through a pair of left and right vent holes 43 of the vertex region ventilator 7.

Having described a specific preferred embodiment of this invention with reference to the accompanying drawings, it is to be understood that the invention is not limited to that precise embodiment, and that various changes and modifications may be effected therein by one skilled in the art without departing from the scope or spirit of the invention as defined in the appended claims.

For example, in the above embodiment, the present invention is applied to the shield 4 of the full-face-type helmet 1. However, the present invention can also be applied to the shield of, e.g., a full-face-type helmet serving also as a jet-type helmet the chin cover of which can be raised, a jet-type helmet and a semi-jet-type helmet.

In the above embodiment, the lower end portion of the inner surface of the negative pressure generating plate portion 22 of the shield 4 is attached and fixed to the upper end portion of the outer surface of the shield main body portion 21. Conversely, the lower end portion of the outer surface of the negative pressure generating plate portion 22 can be attached and fixed to the upper end portion of the inner surface of the shield main body portion 21.

Furthermore, although the negative pressure generating plate portion 22 is formed independently of the shield main body portion 21 in the above embodiment, it can be formed integrally with the shield main body portion 21. In this case, the manufacturing process for the shield main body portion 21 having the negative pressure generating plate portion 22 can be simplified.

The invention claimed is:

1. A shield for a helmet having a rigid body with a chin portion, a forehead portion, and a window opening vertically between the chin portion and the forehead portion, the shield comprising:

a shield structure movable over the window opening into and out of a closed position in which the shield structure reaches vertically from the chin portion of the helmet body to the forehead portion;

the shield structure having a transparent portion for a wearer to view outwardly through the window opening, the transparent portion having an inner surface;

the shield structure also having a horizontal edge which, when the shield structure is in the closed position, defines an upper boundary of an air flow path reaching inward past the horizontal edge; and the shield structure further having an air deflector projecting vertically past the horizontal edge at a location spaced inward from the horizontal edge to deflect air from the air flow path upward across the inner surface of the transparent portion.

2. A shield according to claim 1 wherein the horizontal edge of the shield structure is a horizontal edge of the transparent portion.

3. A shield structure according to claim 1 wherein the horizontal edge of the shield structure is a bottom edge of the transparent portion.

4. A shield according to claim 1 further comprising a structure defining vent holes through which the air flow path reaches inward to the deflector.

5. A shield according to claim 4 wherein the deflector has a length reaching along the horizontal edge, and the vent holes are spaced apart in a row along the length of the deflector.

6. A shield according to claim 4 wherein the structure defining vent holes comprises barrier structures that are spaced apart along the length of the deflector to define the vent holes in spaces between adjacent barrier structures.

7. A shield according to claim 6 wherein the barrier structures comprise parallel walls projecting from the deflector.

8. A shield according to claim 6 wherein the barrier structures reach vertically upward past the horizontal edge of the shield structure to define vertical air guide grooves in spaces between adjacent barrier structures.

9. A shield according to claim 8 wherein the vertical air guide grooves are arranged in one to one correspondence with the vent holes.

10. A shield according to claim 1 further comprising a structure defining vertical air guide grooves reaching upward past the horizontal edge.

11. A shield according to claim 10 wherein the structure defining vertical air guide grooves comprises barrier structures that are spaced apart along the length of the deflector to define the vertical air guide grooves in spaces between adjacent barrier structures.

12. A shield according to claim 11 wherein the barrier structures comprise parallel walls projecting from the deflector.

13. A shield according to claim 1 wherein the shield structure has a main body portion and a negative pressure generating plate portion continuously provided to said main body portion so as to extend substantially upward from a region including an upper end portion of said shield main body portion.

14. A shield according to claim 13, wherein said negative pressure generating plate portion is formed independently of said main body portion and thereafter attached to said main body portion.

15. A shield according to claim 4 wherein the number of vent holes falls within a range of 20 to 300.

16. A shield according to claim 4 wherein the number of vent holes falls within a range of 30 to 200.

17. A shield according to claim 4 wherein the vent holes have an average cross-section area that falls within a range of 1.5 $mm^2$ to 80 $mm^2$.

18. A shield according to claim 4 wherein the vent holes have an average cross-section area that falls within a range of 2 $mm^2$ to 40 $mm^2$.

19. A shield according to claim 4 wherein the vent holes have an average length that falls within a range of 3 $mm^2$ to 40 $mm^2$.

20. A shield according to claim 4 wherein the vent holes have an average length that falls within a range of 4 mm to 30 mm.

21. A shield according to claim 5 wherein adjacent ones of the vent holes have an average gap that falls within a range of 0.1 mm to 3 mm.

22. A shield according to claim 5 wherein adjacent ones of the vent holes have an average gap that falls within a range of 0.2 mm to 2 mm.

23. A shield according to claim 8 wherein the vertical air guide grooves have an average width that falls within a range of 0.5 mm to 10 mm.

24. A shield according to claim 8 wherein the vertical air guide grooves have an average width that falls within a range of 1 mm to 6 mm.

25. A shield according to claim 1 wherein the deflector in a developed state has a length in the horizontal direction that falls within a range of 8 cm to 40 cm.

26. A shield according to claim 3 wherein the deflector in a developed state has a length in the horizontal direction that falls within a range of 12 cm to 32 cm.

27. A helmet including a shield for a helmet according to claim 1.

* * * * *